United States Patent [19]

Nitzberg et al.

[11] Patent Number: 4,951,722

[45] **Date of Patent: * Aug. 28, 1990**

[54] FUEL DISPENSING NOZZLE HAVING A FLOW RATE LIMITER

[76] Inventors: Leonard R. Nitzberg; Paul D. Manhradt, both of Knoxville, Tenn.

[ * ] Notice: The portion of the term of this patent subsequent to Jul. 4, 2006 has been disclaimed.

[21] Appl. No.: 21,399

[22] Filed: Mar. 4, 1987

[51] Int. Cl.[5] ..... B65B 57/04

[52] U.S. Cl. ..... 141/206; 141/209; 141/217; 141/227; 141/392; 137/499; 222/547; 239/571

[58] Field of Search ..... 138/46; 141/206, 392, 141/217, 218; 137/499, 504; 222/547; 239/571, 570, 572; 251/16

[56] References Cited

U.S. PATENT DOCUMENTS

| | | | |
|---|---|---|---|
| 1,855,647 | 4/1932 | Pottenger, Jr. | 138/46 |
| 2,439,117 | 4/1948 | Waterman | 137/499 |
| 2,447,827 | 8/1948 | Torechek | 137/499 |
| 2,890,717 | 6/1959 | Werder | 138/46 X |
| 3,182,334 | 5/1965 | Hammon | 138/43 |
| 3,336,840 | 8/1967 | Alexander | 251/16 |
| 3,556,134 | 1/1971 | Jardinier et al. | 137/499 |
| 3,877,489 | 4/1975 | Louie et al. | 251/16 |
| 3,943,891 | 3/1976 | Kinugawa | 123/478 |
| 4,260,000 | 4/1981 | McGahey | 141/59 |
| 4,437,493 | 3/1984 | Okuda et al. | 137/504 |
| 4,825,916 | 5/1989 | Fink, Jr. | 141/392 |
| 4,832,595 | 5/1989 | Eads | 137/504 |
| 4,844,344 | 7/1989 | Manhardt et al. | 138/40 |

*Primary Examiner*—Henry J. Recla
*Assistant Examiner*—Edward C. Donovan
*Attorney, Agent, or Firm*—Alan Ruderman

[57] ABSTRACT

A flow rate limiting device (40) for a fuel dispensing nozzle (10) having an inlet (12) through which fuel is supplied to said nozzle (10) from a supply hose (14) and an outlet (20) from which fuel is discharged, as into a tank of a vehicle. The device (40) includes a flow restrictor (42) which is mounted in the fuel dispensing nozzle in its internal flow passage (16) the flow restricter (42) is automatically operated to reduce the flow rate, when the flow rate of fuel through said nozzle (10) reaches a preselected threshold rate such as the rate established by governmental regulations. After the flow rate of the fuel in the internal flow passage (16) is reduced below the preselected threshold rate, the flow restriction is attentuated such that the flow in the passage (16) can increase and approach the threshold rate.

11 Claims, 4 Drawing Sheets

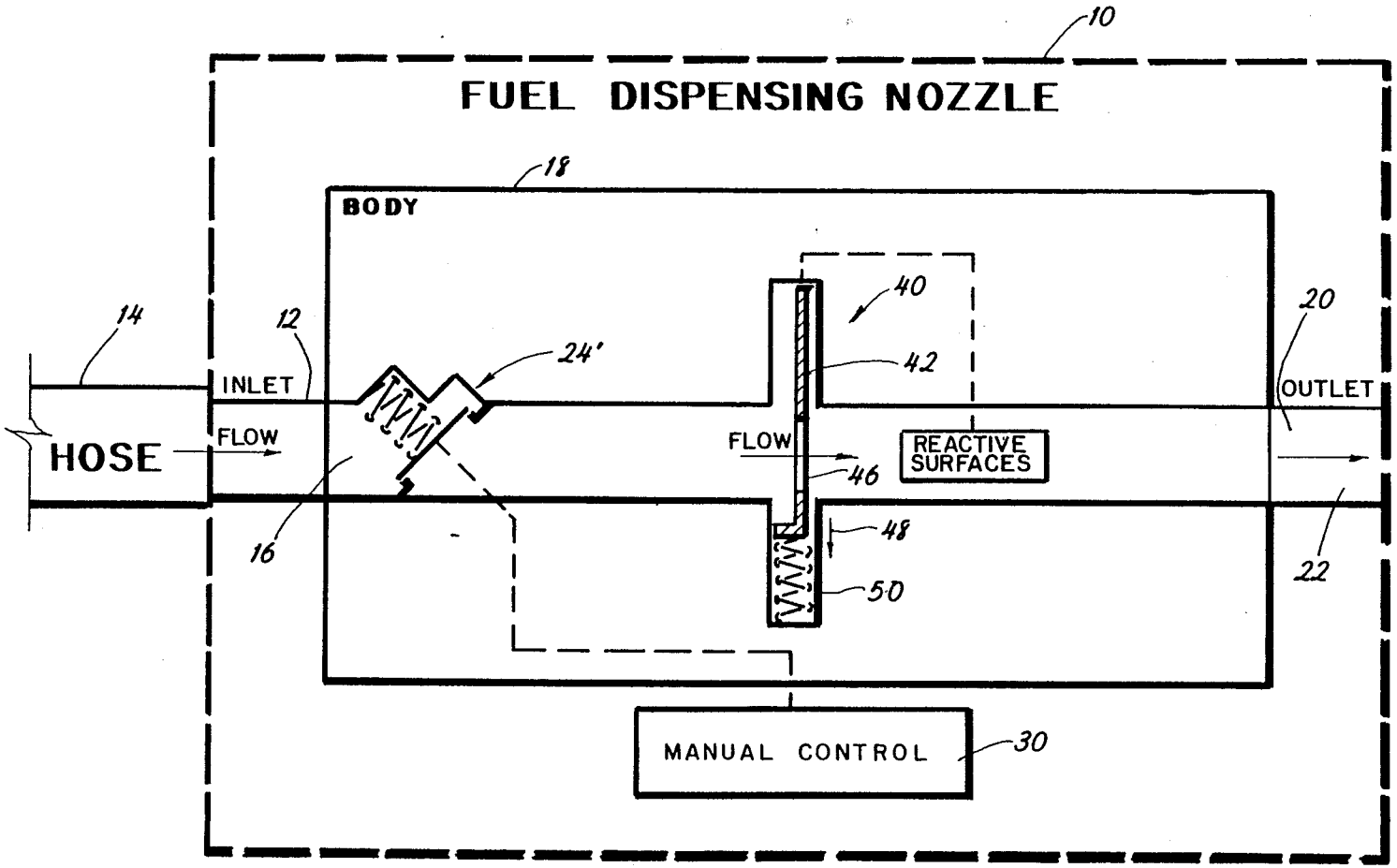
FIGURE-IA

FUEL DISPENSING NOZZLE HAVING A FLOW RATE LIMITER

TECHNICAL FIELD

This invention relates to fuel dispensing nozzles, and more particularly concerns a device for limiting the rate of flow of fuel through a fuel dispensing nozzle such that it is prevented from exceeding a preselected threshold flow rate.

BACKGROUND ART

Fuel dispensing nozzles are commonly used to dispense gasoline or other fuels into fuel tanks of motorized vehicles. Conventional dispensing nozzles include a nozzle body defining an internal flow passage extending between the nozzle inlet and its outlet. The inlet of the nozzle is connected to a supply hose which feeds pressurized gasoline or other fuel to the nozzle. This pressurized fuel passes through the internal flow passage to an outlet which consists of, or is connected to, a spout which serves as the discharge end of the nozzle. The spout is inserted into the neck of a motorized vehicle's fuel tank during filling operations. The pressurized fuel flow through the internal fuel passage is conventionally controlled by a valve which is actuated by a manually operated valve lever selectively depressed by the nozzle user during dispensing operations.

Fuel, under pressure created by a pump, is fed through the nozzle at flow rates established by the pump capacity and the extent to which the valve lever is actuated. It has been found that the rapid flow rates capable of being generated by conventional fuel pumps feeding the nozzle produce gasoline or other fuel fumes which escape into the atmosphere. Due to the wide spread use of dispensing nozzles and the volume of fumes escaping during dispensing operations, government regulations have been passed which are designed to limit the rate of flow of fuel through the dispensing nozzle. By limiting the rate of flow, the amount of fumes escaping can be reduced to a level which is less likely to cause significant damage to the earth's atmosphere.

Accordingly, it is an object of the present invention to provide a flow rate limiting device which is mounted in a fuel dispensing nozzle and serves to limit the rate of flow of fuel through the nozzle.

It is another object of the present invention to provide a flow rate limiting device which can be readily installed in existing dispensing nozzles to place them in compliance with government regulations.

It is also an object of the invention to provide a flow rate limiting device which can be readily manufactured and easily installed.

DISCLOSURE OF THE INVENTION

Other objects and advantages will be obvious to those skilled in the art, and will in part appear hereinafter, and be accomplished by the present invention which provides a flow rate limiting device for fuel dispensing nozzles. The device includes a flow restricter which is mounted in the fuel dispensing nozzle in the internal flow passage along which fuel flows from the nozzle inlet to the outlet. This flow restricter is automatically operable for restricting the flow along the internal flow passage by a predetermined amount when the flow rate through the nozzle reaches a threshold rate. In this connection, the rate of flow through the nozzle is prevented from exceeding the threshold rate. When the rate of flow through the nozzle is less than the threshold flow rate, the flow restricter is automatically operated to reduce the restriction of the flow along said passage by a predetermined amount. In this manner, the rate of flow through the nozzle is maintained below the threshold rate, but can be adjusted such that it approximates the maximum allowable flow rate.

BRIEF DESCRIPTION OF THE DRAWINGS

The above-mentioned features of the present invention will be more clearly understood by considering the following detailed description in connection with the accompanying drawings in which:

FIG. 1A is a block diagram of a fuel dispensing nozzle which diagrammatically illustrates a manually controlled valve and a modified flow limiting device constructed in accordance with various features of the present invention.

BEST MODE FOR CARRYING OUT THE INVENTION

Figure 1:
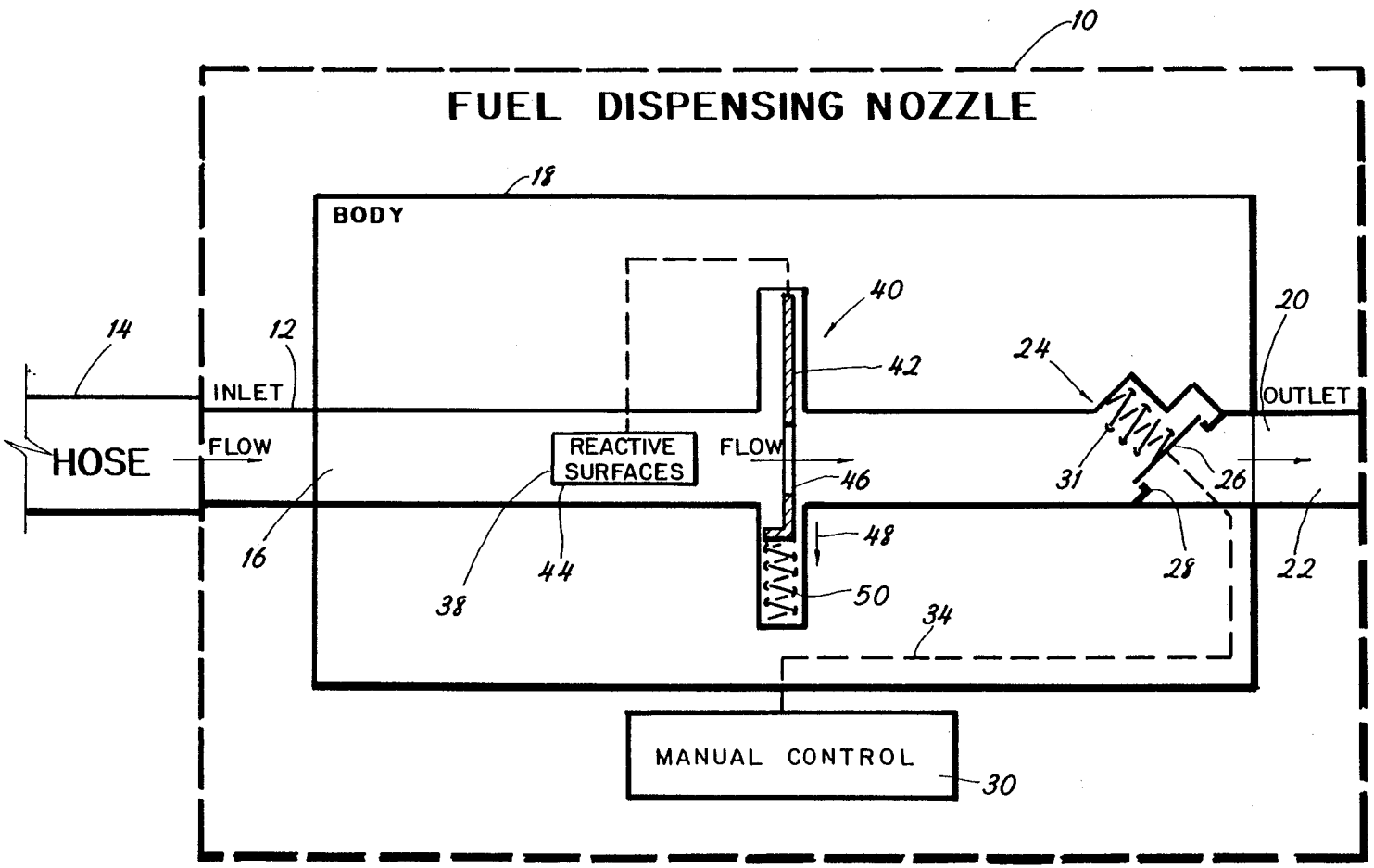
FIG. 1 is a block diagram of a fuel dispensing nozzle which diagrammatically illustrates a manually controlled valve and a flow limiting device constructed in accordance with various features of the present invention.

Referring now to the drawings, a fuel dispensing nozzle is illustrated diagrammatically at 10 in FIG. 1. This nozzle includes an inlet 12 which is mounted in fluid communication with a hose 14 which supplies pressurized fuel such as gasoline to the nozzle 10. This fuel or gasoline is pressurized by the action of a pump (not shown) mounted at a location remote from the nozzle 10. The fuel flows from the hose 14 through a conventional attachment means or coupling into the inlet 12 of the nozzle 10 and enters the internal flow passage 16 of the nozzle 10. This passage 16 extends through the body 18 of the nozzle 10. The internal flow passage 16 terminates at the outlet 20 which normally comprises, or is connected in fluid communication to, a spout 22 through which fuel is dispensed into the fuel tank of a motorized vehicle.

The flow of the fuel through the internal flow passage 16 is controlled in a conventional nozzle by a valve 24 illustrated generally at the right hand side of FIG. 1. This valve 24 is mounted such that when the valve member 26 rests on the valve seat 28, the flow of fuel through the internal flow passage 16 is prohibited. Upon manual operation of the manual control 30, the valve member 26 is moved against the biasing force of the spring 31 thus opening the internal flow passage such that the pressurized fuel can flow therethrough. When the manual control 30 is released, the spring 31 biases the valve member 26 towards the seat 28 and thus closes the internal flow passage and terminates the flow of fuel therethrough. More specifically, it will be noted in FIG. 2 that the manual control 30 comprises a valve lever 32 which engages the rod 34 for moving the valve member 26 away from the valve seat 28 to allow fuel to flow through the internal flow passage which extends between the inlet 12 and the outlet 20, which in the embodiment depicted in FIG. 2 terminates in the spout 22.

It will be noted in the diagrammatical illustration shown in FIG. 14 that the valve 24 is positioned in an alternate position shown at 24'. These positions are shown to illustrate that the manually operable valve 24 may be either upstream or downstream from the flow rate limiting device 40 which will now be described. This device 40 is illustrated diagrammatically in FIG. 1. The flow rate limiting device 40 serves to prevent the fuel from flowing through said internal flow passage 16 at a rate exceeding a preselected threshold rate. This threshold rate has been established by governmental regulations at ten gallons per minute (10 gpm). Accordingly, the flow rate limiting device 40 of the present invention is designed to prevent fuel or gasoline from flowing through the fuel dispensing nozzle 10 at a rate greater than ten gallons per minute. In this connection, the flow rate limiting device 40 includes fuel flow restricting means 42 illustrated diagrammatically in FIG. 1. The flow restricting means 42 is designed to partially block the flow of the fuel through the internal flow passage 16. This flow restricting means 42 can assume various geometric configurations as will be illustrated in greater detail hereinafter. Means 44 are provided for automatically restricting the fuel flow along said internal flow passage 16 by a predetermined amount when the flow rate of the fuel through the nozzle 10 reaches a preselected threshold rate. In the embodiment depicted in FIGS. 1 and 3, the means for automatically restricting the fuel flow is depicted as reactive surface 38 or, as alternatively illustrated in FIG. 1A, reactive surface 38' which are acted against by the fuel flow producing a differential in surface pressure therebetween proportional to the flow rate, and serves to operate the flow restricting means 40 when the flow rate reaches a preselected threshold rate. In the embodiment depicted in FIG. 1, the orifice 46 defined by the flow restricting means 42 is moved downwardly in the direction of the arrow 48 such that the orifice 46 is partially or totally blocked when the flow rate within the internal flow passage exceeds a threshold. After the flow rate has been reduced, means generally indicated at 50 serve to automatically reduce the restriction of the fuel flow along said passage by a predetermined amount. In this connection, the flow restricting means 42 is urged in a direction opposite that of the arrow 48 such that the orifice 46 is opened to allow fuel to flow freely therethrough. In the preferred embodiment, the balancing effect of the means for automatically restricting the fuel flow 44 and the means for automatically reducing the restriction of the fuel flow 50 serve to establish the flow rate of the fuel through the internal flow passage 16 at a rate which approximates the maximum rate allowed by governmental regulations.

Figures 2, 3:
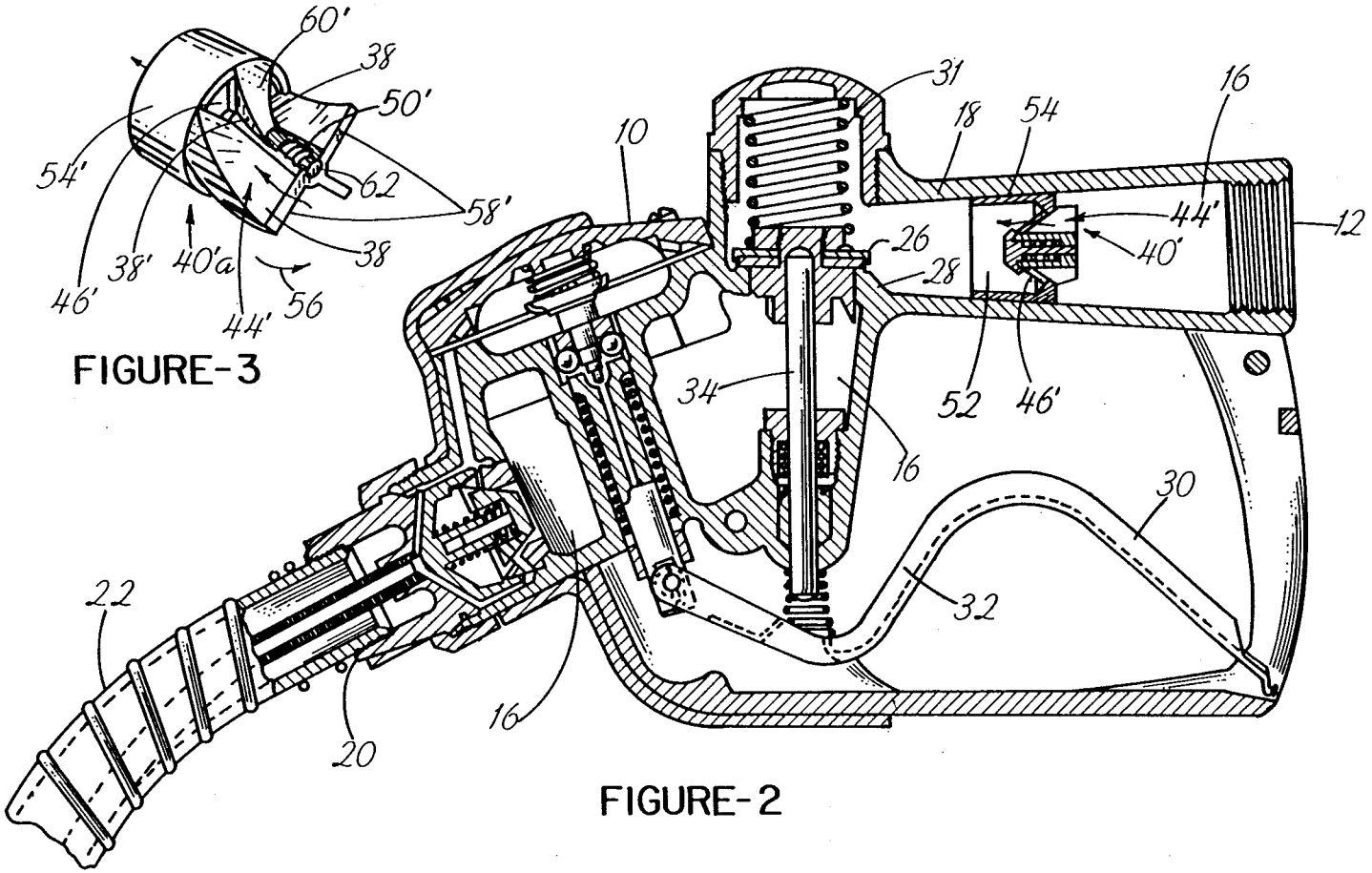
FIG. 2 illustrates a cross-sectional view of a conventional fuel dispensing nozzle having a flow rate limiting device mounted in the internal flow passage of the nozzle.
FIG. 3 is a perspective view of an alternate flow rate limiting device.
Figure 2A:
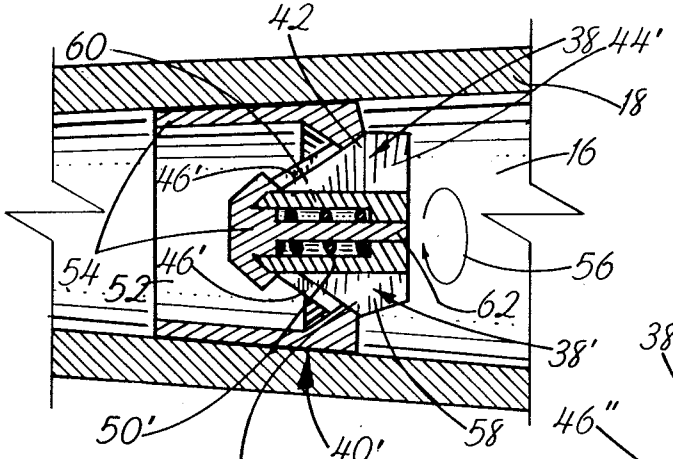
FIG. 2A is a cross-sectional view of the flow rate limiting device shown in FIG. 2.

FIGS. 2 and 2A depict a suitable flow rate limiting device which is constructed in accordance with various features of the present invention, and which is mounted within the internal flow passage 16 defined in the body 18 of the nozzle 10. The particular embodiment of the flow rate limiting device shown in FIGS. 2 and in greater detail in FIG. 2A, is illustrated generally at 40'. This device 40' defines a plurality of orifices 46' which provide fluid communication between the upstream side of the device 40 and the opening 52 in the housing 54. In the embodiment depicted in FIG. 2, it will be noted that the housing 54 is slightly tapered to fit within the tapered flow passage 16 defined proximate the inlet 12 in the nozzle body 18. Means 44' serve to automatically restrict the fuel flow through the flow limiting device 40' by a predetermined amount when the flow rate of the fuel through the nozzle 10 reaches a preselected rate. More specifically, as the flow rate of the fuel through the internal flow passage 16 approaches the preselected threshold rate, the force or pressure against the reactive surfaces 38 and 38' of the means 44' serves to turn the means 44 in the direction of the arrow 56 as shown in FIG. 3. This turning causes at least partial closure of the orifices 46'. In this connection, as the means 44' rotates in the direction of the closure illustrated by arrow 56, the helical blades 58 turn such that the base portions 60 of the blades move to at least partially block the operatively associated orifice 46'. In this connection, the means 44 is rotatably mounted on the housing 54 such that it rotates about the longitudinal axis defined by the pin 62.

When the rate of fuel flowing through the nozzle is reduced below the threshold rate, means generally illustrated at 50' serve to automatically reduce the restriction of the flow through the orifices 46'. More specifically, the means 50' comprises a spring having one end portion connected to the means 44 and the opposite end portion connected to the housing 54 (see FIG. 2A). The spring serves to bias the blades 58 such that the orifices 46' normally remain open. The force of the fuel flow exceeding the threshold rate serves to, at least partially and sometimes completely (as in the event of a sudden surge of pressurized fuel) close the orifices 46'. After the flow rate is reduced below the threshold rate, the biasing force of the spring urges the blades 58 to rotate in a direction opposite the direction of the arrow 56 thereby opening these orifices to the fuel flow. The biasing strength of the spring 50' is predetermined to establish the desired fuel flow threshold rate which triggers closure of the orifices 46'. This balancing effect of the means 44' and the means 50' serves to keep the flow rate below the threshold rate established by governmental regulations. Further, it will be noted that means other than a spring 50' can be used to bias means 44', for example, a hydraulic or pneumatic drive could be used.

FIG. 3 depicts an alternate embodiment of a flow rate limiting device 40*a*' which has like and primed numerals referring to similar components of the device 40' shown in FIGS. 2 and 2A. It will be noted that this device functions similarly to the device 40' and will not be described in great detail. Its housing 54' is substantially cylindrical and defines the orifices 46' which are closed by the base portion 60' of the blades 58'. The spring (not shown) serves the same purpose as the spring 50' shown in FIG. 2A, namely to close the orifices 46' by rotating the means 44' in the direction of arrow 56. The spring for the device 40*a*' is preferably mounted in the housing 54 as shown.

Figure 4:
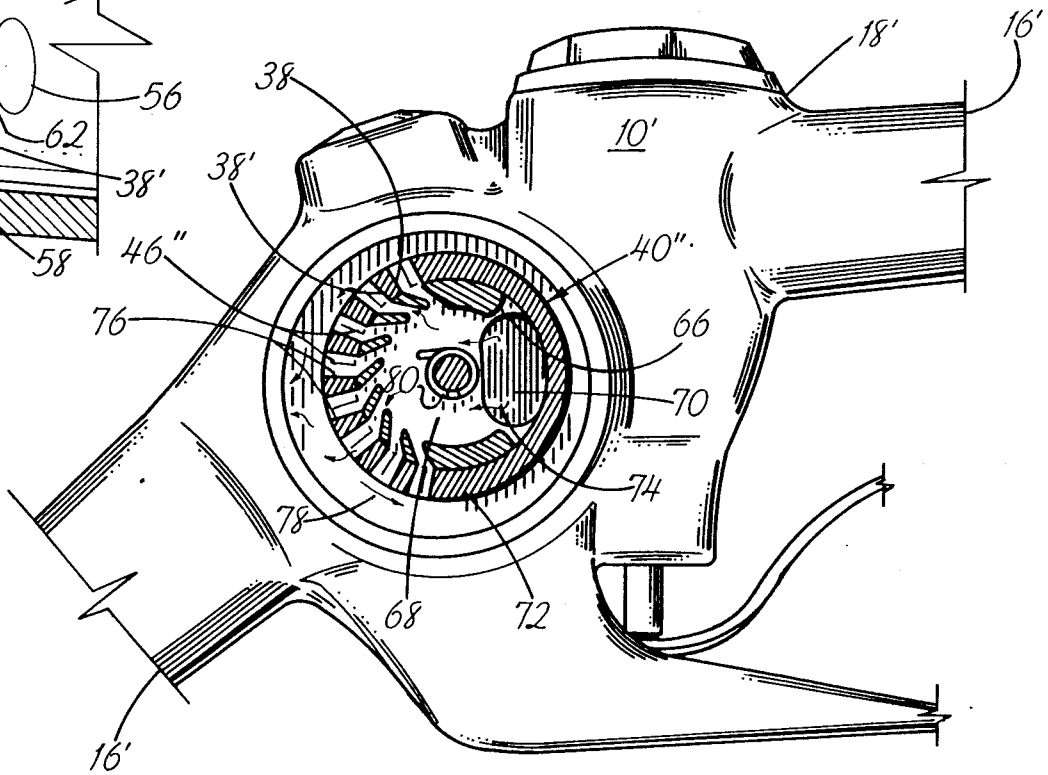
FIG. 4 is an alternate embodiment of a flow rate limiting device mounted within the internal flow passage of another type of fuel dispensing nozzle.

FIG. 4 depicts an alternate embodiment of a flow rate limiting device 40'' mounted in a conventional fuel dispensing nozzle 10' which is different in configuration from the nozzle 10 depicted in FIG. 2. This flow rate limiting device 40'' is mounted within the internal flow passage 16' defined in the nozzle body 18'. Fuel flowing through the passage 16' passes through an inlet port 66 defined in the fixed housing member 68 which is fixedly secured to the wall 70 of the body 18' of the nozzle. This housing member 68 is adapted to rotatably receive members 72 as is shown in FIG. 4. Fuel flowing into the device 40'' through the inlet 66 flows in the direction of the arrow 74. In order to exit the device 40'', the fuel must flow through the orifices or ports 46'' defined in the perimeter of the housing 68 since the nozzle wall closes the housing member 68 as seen in FIG. 4. As long as the flow of the fuel through the device 40'' is below the threshold rate, the orifices 46'' are unrestricted. When the flow rate through the device 40'' exceeds the threshold rate, this flow acts against the surfaces of the barriers 76, and causes the member 72 to rotate in the direction of the arrow 78 which is the direction of closure. Thus, the barriers 76 which cooperate with the operatively associated orifices 46'' or ports serve as the means 44'' for automatically restricting the flow of fuel through the ports 46'' when the threshold rate is reached. After the flow rate reduction occurs such that the flow rate is less than the threshold rate, the spring 80 having one end portion connected to the member 68 as illustrated and the opposite end (not shown) portion connected to the housing 72 proximate the inlet port 66, rotates the member 72 in a direction opposite the direction of the arrow 78. In this connection, the spring 80 serves as means for automatically reducing the restriction of the flow by moving the barriers 76 such that they no longer block or reduce the blockage of the flow of fuel through the ports or orifices 46''.

It will be noted that the spring serves to bias the device such that the flow restricting means is maintained at a position which can be established by a suitable stop. In this position, the fuel is free to flow through the device 40' and 40''.

From the foregoing detailed description, it will be recognized that a flow rate limiting device has been provided which is designed to limit the flow of fuel or gasoline through a dispensing nozzle. In the preferred embodiment of the device, a balancing effect is established between means for automatically restricting the fuel flow and means for automatically reducing the restriction of the flow such that the flow rate can approximate, but is less than, the flow rate established by government regulations as a maximum. The device is designed to be readily installed in the internal flow passage of nozzles in both original equipment and retrofit applications. Further, the device is simple in structure and requires little maintenance.

Thus, although there has been described to this point particular embodiments of the present invention of a flow rate limiting device, it is not intended that such specific references be considered as limitations upon the scope of the invention except insofar as is set forth in the following claims and equivalents thereof.

We claim:

1. A fuel dispensing nozzle having an inlet through which liquid fuel is supplied to said nozzle under pressure, an outlet, means adapted to discharge fuel into a fuel tank of a vehicle, an internal flow passage along which said fuel flows from said inlet to said outlet, manually operable valve means disposed within said passage intermediate said inlet and said outlet for selectively opening communication between said inlet and said outlet to permit fuel to flow from said inlet to said outlet, and flow rate limiting means for limiting the volumetric rate of fuel flowing through said nozzle to a predetermined maximum rate independent of the fuel inlet pressure and independent of the amount of communication provided between said inlet and said outlet by said valve means, said flow rate limiting means comprising:

flow restricting means mounted in said fuel dispensing nozzle in said internal flow passage along which said fuel flows from said inlet to said outlet;

automatic operating means for automatically operating said flow restricting means for restricting said fuel flow along said passage to said predetermined rate when the flow rate of said fuel through said nozzle reaches said rate whereby the rate of fuel flowing through said nozzle is prevented from exceeding said rate; and means for automatically reducing the restriction of said flow along said passage when the rate of flow of said fuel through said nozzle is less than said rate.

2. The fuel dispensing nozzle of claim 1 wherein said flow restricting means mounted in said fuel dispensing nozzle comprises orifice defining means which defines at least one orifice and means for restricting the flow of fuel through said orifice which is operatively associated with said orifice defining means.

3. The fuel dispensing nozzle of claim 2 wherein said means for automatically operating said flow restricting means includes a reactive surface against which fuel flowing through said internal flow passage operates, said reactive surface being operatively associated with said means for restricting the flow of fuel through said orifice defined in said defining means.

4. The fuel dispensing nozzle of claim 3 wherein said means for automatically reducing the restriction of said flow along said passage comprises a spring which biases said means for restricting the flow of fuel through said orifice defining means in a direction to reduce the blockage of said orifice.

5. A fuel dispensing nozzle having an inlet through which liquid fuel is supplied to said nozzle from a supply hose under pressure, an outlet, means adapted to discharge fuel into a fuel tank of a vehicle, an internal flow passage along which said fuel flows from said inlet to said outlet, manually operable valve means disposed within said passage intermediate said inlet and said outlet for selectively opening communication between said inlet and said outlet to permit fuel to flow from said inlet to said outlet, and flow rate limiting means for limiting the volumetric rate of fuel flowing through said nozzle to a predetermined maximum rate independent of the fuel inlet pressure and independent of the amount of communication provided between said inlet and said outlet by said valve means, said flow rate limiting means comprising:

orifice defining means mounted in said internal flow passage of said nozzle, said orifice defining means defining at least one orifice;

automatic operating means for slidably engaging said orifice defining means and restricting said flow of fuel through said orifice, said operating means including a reactive surface against which said fuel flowing through said internal flow passage operates for moving said operating means to a position at least partially occluding said orifice, whereby said operating means restricts said fuel flow along said passage to said predetermined rate when the flow rate of said fuel through said nozzle reaches said rate such that the rate of fuel flowing through said nozzle is prevented from exceeding said rate; and means for automatically reducing the restriction of said flow along said passage when the rate of flow of fuel through said nozzle is less than said rate.

6. The flow rate limiting device of claim 5 wherein said means for automatically reducing the restriction of said flow along said passage comprises a spring which biases said operating means in a direction to reduce occlusion of said orifice.

7. The flow rate limiting device of claim 5 wherein said automatic operating means is rotatably mounted within said passage whereby said flow of fuel acting against said reactive surface rotates said operating means in a direction to occlude said orifice.

8. The flow rate limiting device of claim 7 wherein said automatic operating means includes a plurality of helical blade members, each said blade member defining at least one said reactive surface.

9. The flow rate limiting device of claim 8 wherein said orifice defining means defines a plurality of radially disposed orifices, each said orifice being operatively associated with one said blade member, and wherein each said blade member defines a base portion for being rotated in response to said flow of fuel acting against said reactive surface of said blade member whereby said base portion at least partially occludes said operatively associated orifice.

10. The flow rate limiting device of claim 9 wherein said means for automatically reducing the restriction of said flow along said passage comprises a spring which biases said operating means in a direction to reduce occlusion of said orifice.

11. A fuel dispensing nozzle having an inlet through which liquid fuel is supplied to said nozzle from a supply hose under pressure, an outlet from which fuel is discharged as into a fuel tank of a vehicle, an internal flow passage along which said fuel flows from said inlet to said outlet, manually operable valve means disposed within said passage intermediate said inlet and said outlet for selectively opening communication between said inlet and said outlet to permit fuel to flow from said inlet to said outlet, and flow rate limiting means for limiting the volumetric rate of fuel flowing through said nozzle to a predetermined maximum rate independent of the fuel inlet pressure and independent of the amount of communication provided between said inlet and said outlet by said valve means, said flow rate limiting means comprising:

orifice defining means mounted in said internal flow passage of said nozzle, said orifice defining means including a housing having an axially aligned pin and defining a plurality of radially disposed orifices;

automatic operating means for restricting said flow of fuel through said orifice, said operating means being rotatably received on said pin of said housing of said orifice defining means, said operating means including a helical blade member operatively associated with each said orifice, each said blade member defining a base portion and a reactive surface against which said fuel flowing through said internal flow passage operates for moving said base portions of said blade members to a position at least partially occluding said operatively associated orifice, whereby said operating means restricts said fuel flow along said passage to said predetermined rate when the flow rate of said fuel through said nozzle reaches said rate such that the rate of fuel flowing through said nozzle is prevented from exceeding said rate; and means for automatically reducing the restriction of said flow along said passage when the rate of flow of said fuel through said nozzle is less than said rate, including a spring which biases said operating means in a direction to reduce occlusion of said orifices.

* * * * *